United States Patent [19]

Ueda et al.

[11] Patent Number: 5,030,296

[45] Date of Patent: Jul. 9, 1991

[54] PROCESS FOR PRODUCTION OF CR-NI TYPE STAINLESS STEEL SHEET HAVING EXCELLENT SURFACE PROPERTIES AND MATERIAL QUALITY

[75] Inventors: Masanori Ueda; Shinichi Teraoka, both of Kitakyushu; Hidehiko Sumitomo; Toshiyuki Suehiro, both of Hikari; Masayuki Abe, Kitakyushu; Shigeru Minamino, Hikari, all of Japan

[73] Assignee: Nippon Steel Corporation, Tokyo, Japan

[21] Appl. No.: 474,772

[22] PCT Filed: Jul. 10, 1989

[86] PCT No.: PCT/JP89/00692

§ 371 Date: Mar. 7, 1990

§ 102(e) Date: Mar. 7, 1990

[87] PCT Pub. No.: WO90/00454

PCT Pub. Date: Jan. 25, 1990

[30] Foreign Application Priority Data

Jul. 8, 1988 [JP] Japan ..... 63-169095
Sep. 6, 1988 [JP] Japan ..... 63-221471
Sep. 6, 1988 [JP] Japan ..... 63-221472

[51] Int. Cl.[5] ..... C21D 8/04

[52] U.S. Cl. ..... 148/2; 164/476; 164/485; 164/486

[58] Field of Search ..... 164/476, 479, 480, 485, 164/486; 148/2

[56] References Cited

U.S. PATENT DOCUMENTS 4,420,347 12/1983 Ueda et al. ..... 148/2

FOREIGN PATENT DOCUMENTS 306076 3/1989 European Pat. Off. ..... 148/2
63-421 1/1988 Japan .
273917 3/1990 Japan .

*Primary Examiner*—Deborah Yee
*Attorney, Agent, or Firm*—Kenyon & Kenyon

[57] ABSTRACT

A process in which a cast strip of Cr-Ni type stainless steel having a thickness close to a product thickness is prepared by the synchronous continuous casting. By subjecting the cast strip just below the casting machine to rapid cooling in the high-temperature region, hot-working or cold-working the cast strip and subjecting the cast strip to annealing or the like, γ grains in the cast strip are made finer, and by carrying out cooling in the low-temperature region of temperatures lower than 900° C., precipitation of Cr carbide in the grain boundary is prevented. Thus, occurrence of roping or uneven gloss on the surface of the stainless steel sheet is controlled.

10 Claims, 7 Drawing Sheets

δ−Fe·cal(%) = −2.3%(×100)

δ−Fe·cal(%) = −1.1%(×100)

δ−Fe·cal(%) = 3.0 %(×100)

PROCESS FOR PRODUCTION OF CR-NI TYPE STAINLESS STEEL SHEET HAVING EXCELLENT SURFACE PROPERTIES AND MATERIAL QUALITY

DESCRIPTION

1. Technical Field

The present invention relates to a process for the production of a Cr-Ni type stainless steel sheet, by which the thickness of a cast strip is made almost the same as the product thickness by a synchronous continuous casting process in which the relative speed of the cast strip to the inner wall surface of a casting mold is the same. In particular, it relates to a process by which the microstructure is made finer from the cast strip stage to form a Cr-Ni type stainless steel sheet having excellent surface properties.

2. Background Art

In the conventional continuous casting process for the production of a stainless steel sheet, a slab having a thickness of more than 100 mm is formed by casting while vibrating a casting mold in the casting direction, the obtained slab is surface-finished, the slab is heated at a temperature higher than 1000° C. in a heating furnace, and the slab is hot-rolled by a hot strip mill comprising rows of rough rolling machines and finish rolling machines, to form a hot strip having a thickness of several mm.

After the cold rolling of the obtained hot strip, to maintain the shape (flatness), quality and surface properties required for the final product, a hot-roll plate annealing for softening the hot strip, which has been subjected to a severe hot working, is carried out, and surface scale and the like removed first by a pickling process and then by grinding. In this conventional process for the production of a thick continuous cast slab, much energy is needed to heat the slab and carryout the processing, and thus this process is disadvantageous from the viewpoint of productivity. Furthermore, since a final product is prepared from an slab having a thickness of more than 100 mm through several processes, a texture is developed in a specific orientation in the obtained product, and therefore, when press-forming is carried out by a user, the anisotropy and many other application limitations must be taken into consideration.

To solve the above problems of the process for hot-rolling a thick continuous cast slab having a thickness of more than 100 mm, research has recently been made in to a process by which a cast strip (band steel) having the same or almost the same thickness as the hot strip is prepared during the continuous casting. For example, "Tetsu to Hagane", '85, A197 to '85, A256 discloses a process by which a hot strip is directly prepared by continuous casting. In this continuous casting process, a twin-drum method was used to obtain a cast strip having a thickness of 1 to 10 mm and a twin-belt method was used to obtain a cast strip having a thickness of 20 to 50 mm. This new casting process in which the relative speed of the cast strip to the inner wall surface of a casting mold is the same is called "a synchronous continuous casting process".

In this continuous casting process, however, a problem arises during the casting process, and the problems of quality and surface properties of the product remain.

In the process for preparing a cast strip (band steel) having the same or almost the same thickness equal as that of a hot strip, by continuous casting, since the processes of from the casting to the withdrawal of the product are simplified, the surface properties of the stainless steel product are easily influenced by the properties of the cast strip. Namely, to obtain a product having excellent surface properties, it is necessary to obtain an excellent cast strip.

DISCLOSURE OF THE INVENTION

Under this background, an object of the present invention is to provide a continuous casting process for the production of a stainless steel cast strip having a thickness of less than 10 mm, in which an excellent cast strip capable of providing a product having excellent surface properties and quality can be prepared.

More specifically, the object of the present invention is to provide a simple process capable of forming a Cr-Ni type stainless steel sheet which does not have an uneven gloss and surface defect called a "roping phenomenon" inherently observed in stainless steel sheets prepared by the thin continuous casting apparatus.

As the result of investigations made into the above-mentioned process with a view to eliminating the surface defects from the product, the inventors succeeded in preventing the occurrence of roping on the surface of a product by making the austenite ($\gamma$) grain size of a cast strip finer by controlling the cooling of the strip cast in a high temperature zone (zone of temperature is higher than 1100° C.) and preventing the occurrence of an uneven gloss by controlling the cooling in a low temperature zone (zone of temperatures of 900 to 550° C.).

The inventors engaged in further research and found that, if the above-mentioned $\gamma$ grain size is kept below 50 $\mu$m, a high degree of a prevention of roping can be attained and developed rapid cooling methods for a high-temperature cast strip, cold-rolling methods, and hot rolling methods as the means for the above-mentioned adjustment of the $\gamma$ grain size. The present invention was completed based on the foregoing findings.

In accordance with one aspect of the present invention, there is provided a process for the production of a Cr-Ni type stainless steel sheet having an excellent surface and cast strip property, which comprises continuously casting a Cr-Ni type stainless steel represented by 18% Cr-8% Ni steel into a cast strip having a thickness smaller than 10 mm at a cooling rate of at least 100° C./sec at the solidification by using a continuous casting machine in which the wall surface of a casting mold moves synchronously with the cast strip, $\delta$-ferrite ($\delta$-Fe.) cal (%) defined by the formula of $\delta$-Fe.cal (%)$=3(Cr+1.5\ Si+Mo+Nb+Ti)-2.8(Ni+\frac{1}{2}\ Mn+\frac{1}{2}\ Cu)-84(C+N)-19.8$ (%) being controlled to -2 to 10% to form a primary crystal of the $\delta$ phase at the solidification, lower the temperature of initiation of crystallization or precipitation of $\gamma$ phase, and depress the grain growth of $\gamma$ during and after the solidification, initiating cooling of the obtained cast strip at a temperature as high as possible, cooling the cast strip to 1100° C. at a cooling speed of at least 100° C./sec while preventing reheating of the cast strip to make the $\gamma$ grains finer, then cooling the cast strip at a temperature of from 900° to 550° C. and an average cooling rate of at least 50° C./sec to prevent precipitation of carbides and forming the cast strip into a cold-rolled sheet according to customary procedures. In accordance with another aspect of the present invention, there is provided a preparation process in which a hot-rolling, cold-rolling, or annealing process is added as the above-mentioned cooling-controlling methods.

The present invention will now be described in detail.

The following experiments were conducted to determine the surface properties of products.

A molten steel comprising SUS 304 steel as the main component was cast by a twin-roll (twin-drum) continuous casting machine of the internal water-cooling type to form a cast strip having a thickness of 2 to 4 mm, and the cast strip was cooled and wound.

The obtained cast strip (thin band) was subjected to descaling, directly cold-rolled, finally annealed, and pickled to obtain a 2B product. The surface properties of the obtained product were examined and compared with those of a conventional product obtained by heating a slab having a thickness larger than 100 mm, hot-rolling the ingot by a hot strip mill, and cold-rolling the hot-rolled strip.

As a result, it was found that there is a risk of the formation of the following surface defects in the 2B product obtained by casting the molten steel into a cast strip having a thickness of 2 to 4 mm by using the twin-roll (twin-drum) continuous casting machine of the internal water-cooling type, cold-rolling the cast strip, and carrying out final annealing and pickling.

(1) Roping or orange peel (fine convexities and concavities are formed on the surface during a cold rolling or processing of the product)

(2) Uneven gloss (uneven gloss is caused by a sensitization of the microstructure of the cast strip, intergranular oxidation, or coarsening of $\gamma$ grains during a winding of the cast strip, that is, the thin band)

This problem in the surface properties of the product is not observed in the conventional process but is inherently observed in a process including the step of directly obtaining a cast strip (thin band) by continuous casting.

The inventors examined the cause of this problem of the surface properties of the product in detail and, as a result found that, where the 7 grain size of the cast strip before cold-rolling is larger or cooling in the Cr carbide-precipitating temperature range is insufficient, the above-mentioned surface defects become prominent.

Thus, it has been found that to prevent roping, it is preferable to make the $\gamma$ grain size of the cast strip before cold-rolling finer, especially to adjust this $\gamma$ grain size above No. 6, that is, below 50 $\mu$m, and to prevent uneven gloss, it is preferable to control the cooling of the cast strip in the low temperature range, where a process including the step of directly obtaining the cast strip by continuous casting is adopted.

The basic techniques for attaining the above-mentioned objects will now be described. The components of the molten steel of the present invention are first explained.

The composition of the molten steel comprises 0.01 to 0.08% of C, 0.25 to 1.50% of Si, 0.15 to 3.0% of Mn, 0.015 to 0.040% of P, 0.001 to 0.008% of S, 16.0 to 28.0% of Cr, 6.0 to 24.0% of Ni, 0.015 to 0.33% of N, 0.001 to 0.050% of Al, 0.01 to 3.0% of Mo, 0.01 to 2.0% of Cu, 0.01 to 0.60% of Ti, and 0.01 to 0.80% of Nb, with the balance being Fe and unavoidable impurities.

A molten steel having the above-mentioned composition is cast into a strip, that is, a cast strip having a thickness smaller than 10 mm, at a cooling speed of at least 100° C./sec by a twin-roll or single-roll continuous casting machine. If the thickness of the cast strip exceeds 10 mm, it becomes difficult to make the $\gamma$ grains finer, and becomes difficult to obtain the product by a direct cold-rolling.

As the means for making $\gamma$ grains of the obtained cast strip finer, a method is adopted in which cooling of the cast strip is initiated at a temperature as high as possible just below the casting machine, to prevent reheating of the cast strip at the outlet of the continuous casting machine, and cooling is effected to 1100° C. while maintaining the cooling rate in the $\gamma$ grain-growing temperature range at a level of at least 100° C./sec and as high as possible, whereby the grain growth of $\gamma$ is inhibited.

Selection of the alloy composition based on the above-mentioned cooling as the premise is important.

FIG. 1 is a diagram showing the sectional state of the portion corresponding to Creq+Nieq=30% in the equilibrium diagram of the Fe-Cr-Ni ternary system, as disclosed in (Transaction of JWRI., Vol. 14, No. 1, 1985, page 125), and Creq and Nieq are calculated from the contents of the components according to the following formulae:

$$Creq = Cr\,(\%) + 1.5 \times Si\,(\%) + Mo\,(\%) + Nb\,(\%) + Ti\,(\%)$$

$$Nieq = Ni\,(\%) + \tfrac{1}{2}\,Mn\,(\%) + \tfrac{1}{2}\,Cu\,(\%) + 30[C\,(\%) + N\,(\%)]$$

In the case (1) Where Creq is small, the primary crystal is solidified at $\gamma$ at Creq=17.3% and is completely formed in the $\gamma$ phase. In this case, the $\gamma$ phase is crystallized at a temperature higher than 1450° C., just below the liquidus, and the $\gamma$ phase then grows. In the case (2) where Creq increases and is 19.5% or higher, solidification of the primary crystal is completed in the $\delta$ phase, and precipitation of the $\gamma$ phase begins at about 1370° C. as the result of solid phase reaction, and the $\gamma$ phase then grows. In this case, the grain growth of $\gamma$ is greatly controlled, compared with the above-mentioned case where Creq is small. This can be understood from the fact that the grain growth of $\gamma$ is influenced by the high temperature range just after solidification. In the case where Creq is an intermediate value, a peritectic reaction is added and the system becomes complicated, but in this case, a composition causing $\delta$ solidification is advantageous to depress the grain growth of $\gamma$. The combination of selection of the composition retarding initiation of precipitation of $\gamma$ grains by utilizing $\delta$ solidification and rapid cooling in the high temperature range is especially effective for controlling the grain growth of $\gamma$ and making $\gamma$ grains finer.

From the results of experiments made on various compositions, it was found that good effects are attained if $\delta$-Fe.cal (%) defined by the formula of $\delta$-Fe.cal (%)=3(Cr+1.5 Si+Mo+Nb+Ti)−2.8(Ni+½ Mn+½ Cu)−84(C+N)−19.8 (%) is adjusted from −2 to 10%.

FIGS. 2(*a*), 2(*b*), and 2(*c*) are metallographic microscope photos of microstructure of cast strip obtained by casting compositions differing in $\delta$-Fe.cal (%) into 2-mm cast strip and cooling them. As apparent from the drawings, when $\delta$-Fe.cal (%) is −2.3%, $\gamma$ solidification is caused and $\gamma$ grains grow. Where $\delta$-Fe.cal (%) is −1.1%, $\delta$ ferrite is left and the size of $\delta$ grains is reduced. When $\delta$-Fe.cal (%) is 3.0%, $\delta$ solidification is apparently caused and the size of $\gamma$ grains is kept small. If $\delta$-Fe.cal (%) is larger, both of the sizes of $\gamma$ grains and $\delta$ grains are kept small. Namely, the combination of the above-mentioned cooling of the cast strip and selection of the composition in the Cr-Ni system has large influences on the reduction of the size of $\gamma$ grains, and it is very important to control $\delta-$Fe.cal (%) from $-2$ to 10%. Even if $\delta-$Fe.cal (%) exceeds 10%, the above-mentioned effect becomes saturated, and the $\delta$ phase is left in the product and bad influences are imposed on the product quality.

The cast strip must be cooled in the temperature range of 900° to 550° C. at an average cooling rate of at least 50° C./sec and the cast strip wound at a temperature lower than 650° C. If this requirement is not satisfied, carbides are precipitated in the grain boundary of the cast strip and intergranular corrosion is caused at the process of pickling the cast strip, resulting in degradation of the gloss of the final product.

By depressing the grain growth of $\gamma$ in the cast strip and preventing precipitation of carbides in the grain boundary by the above-mentioned methods, occurrence of roping and uneven gloss on the surface of the stainless steel can be prevented.

The above-mentioned basic technique is very effective for making $\gamma$ grain finer, and to reduce the average grain size of $\gamma$ grains below 50 $\mu$m, an addition of the following means is especially effective.

(1) Reduction of the size of $\gamma$ grains of the cast strip per se.

(2) Recrystallization for reduction of the size of the $\gamma$ grains by hot-working the cast strip subsequently to casting.

(3) Recrystallization for reduction of the size of the $\gamma$ grains by cold-working and annealing of the cast strip.

It was found that even though a high effect is attained if one of the foregoing means (1), (2), and (3) is adopted, an especially high effect can be attained if two or more of the above-mentioned means (1), (2), and (3) are adopted in combination. The present invention was completed based on this finding.

BEST MODE OF CARRYING OUT THE INVENTION

Specific means for adjusting the average grain size of $\tau$ of the cast strip below 50 $\mu$m, which are adapted in addition to the above-mentioned basic technique, will now be explained.

(1) Method of reducing the size of $\gamma$ grains of the cast strip per se

In the method of reducing the size of 7 grains of the cast strip by the twin-roll or single-roll continuous casting, in order to reduce the size of $\gamma$ grains at the time of solidification and control the subsequent grain growth of $\gamma$, the cooling must be started at a high temperature.

In the cast strip by the above-mentioned method, $\gamma$ grains abruptly grow after the solidification. Accordingly, in order to depress the average grain size of $\gamma$ below 50 $\mu$m, it is necessary that cooling should be started just after completion of the solidification, reheating of the cast strip at the outlet of the casting machine should be inhibited, and rapid cooling should be carried out in the $\gamma$ grain growing range of temperatures of up to 1200° C. and that the average cooling rate during this rapid cooling should be adjusted to a level of at least 200° C./sec.

Figure 1:
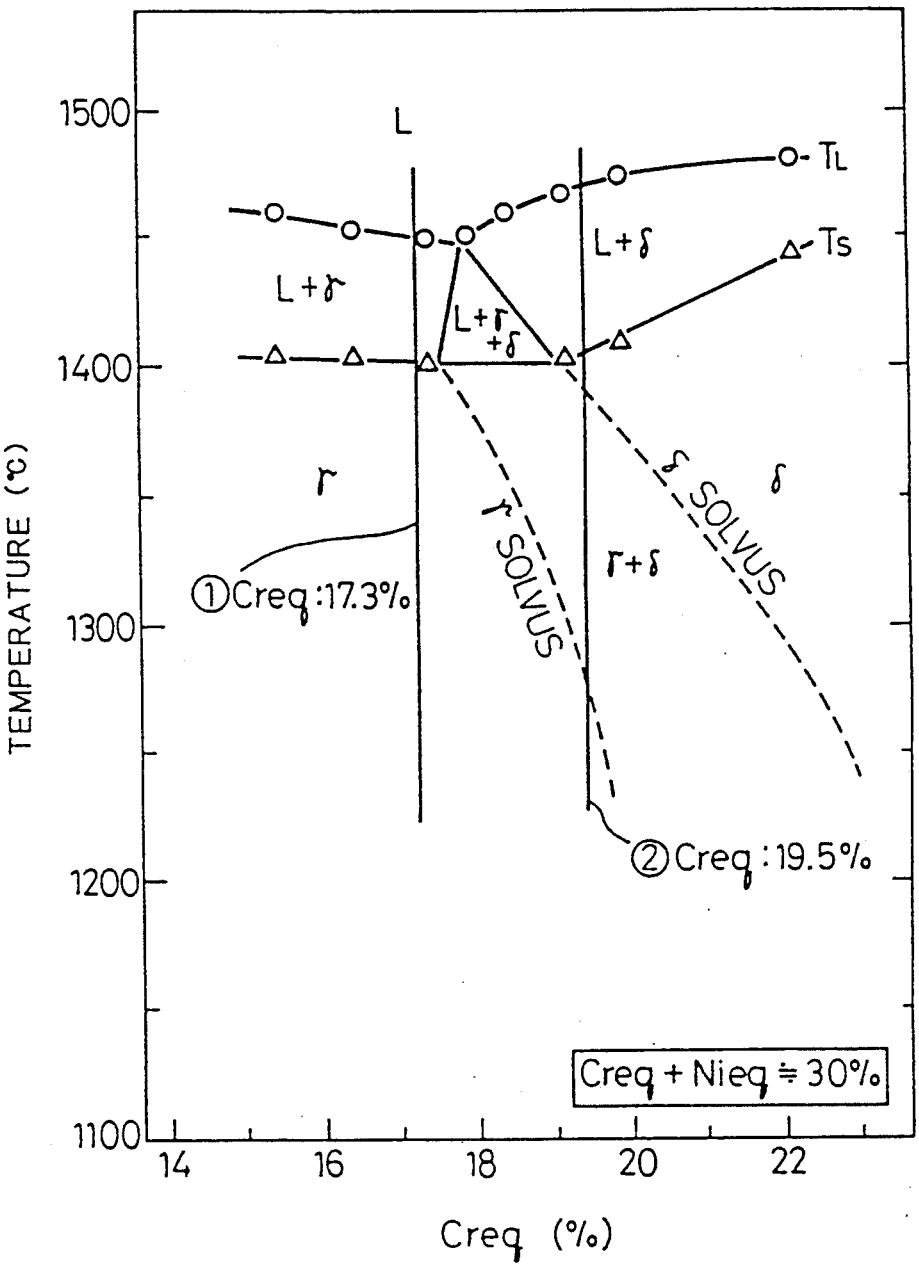
FIG. 1 is a sectional state diagram of the portion corresponding to Creq+Nieq=30% in the equilibrium stage diagram of the Fe-Cr-Ni ternary system.
Figure 2A:
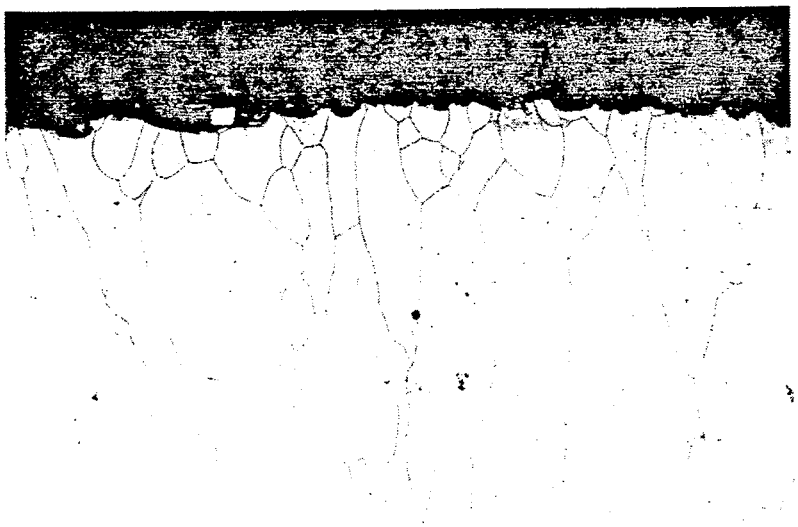
FIG. 2(*a*), 2(*b*) and 2(*C*) are metallographical microscope photographs showing the microstructures of cast strips having a thickness of 2 mm, which are obtained by continuous casting of molten steels differing in $\delta$-Fe.cal (%).
Figure 2B:
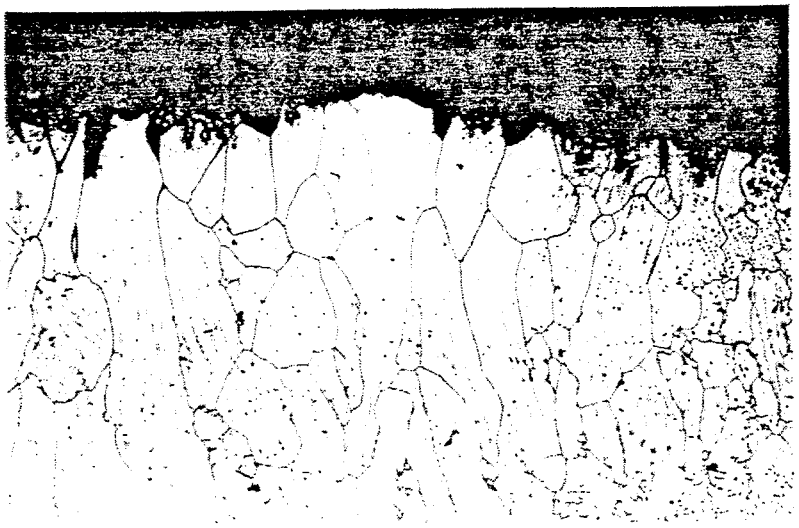
Figure 2C:
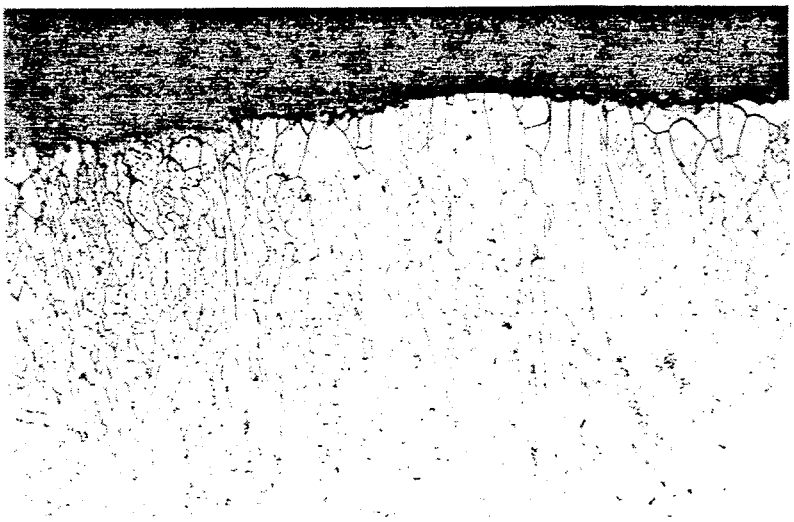
Figure 3:
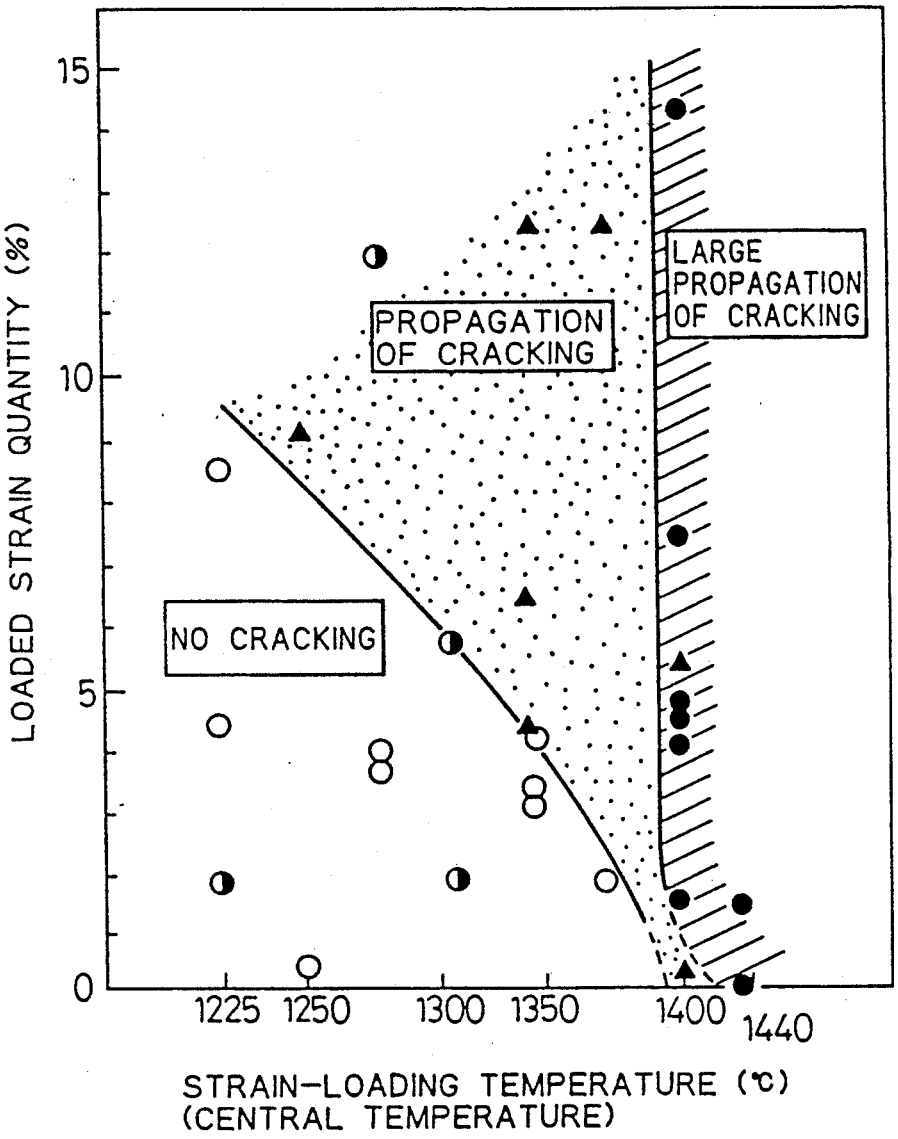
FIG. 3 is a diagram illustrating the relation between the strain load just below the melting point and occurrence of cracking in SUS 304 steel.

In the above-mentioned method, cooling of the cast strip just after the solidification, especially uniform cooling, is important. In the strip casting of the Cr-Ni system, embrittlement of the cast strip at the time of solidification is another problem. From the results of experiments it was found that, in the 18 Cr-8 Ni system, high-temperature embrittlement is especially large at a temperature lower by about 50° C. than the solidification point, and that, for example, in case of 18 Cr-8 Ni alloy, if the temperature is lower than 1390° C. in the central portion of the cast strip, the high-temperature ductility of the alloy is highly restored (FIG. 3). Accordingly, at lower temperatures, a method is advantageously adopted in which a roll of the internal cooling type is used and roll cooling is carried out at a certain reduction for example, a reduction lower than 5%. By using a pair or a plurality of pairs of rolls for the roll cooling, it is possible to perform the cooling effectively while preventing reheating, and the cooling can be effected to 1200° C. at an average cooling speed of at least 200° C./sec. Of course, uniform cooling can be effectively accomplished by the combination of this roll cooling with gas cooling under a high pressure with air or nitrogen or mist cooling using a small amount of a liquid incorporated in such as gas. Of course, these cooling methods can be adopted singly.

(2) Method in which the cast strip is hot-processed subsequently to casting to reduce the particle size by recrystallization According to this method, the as-cast strip is subjected to hot-processing to advance recrystallization and reduce the size of $\gamma$ grains. Namely, the cast strip is rapidly cooled from the high-temperature range just below the casting machine to depress the grain growth of $\gamma$ in the cast strip, and then, hot-rolling is carried out to obtain finer $\gamma$ grains.

Figure 4:
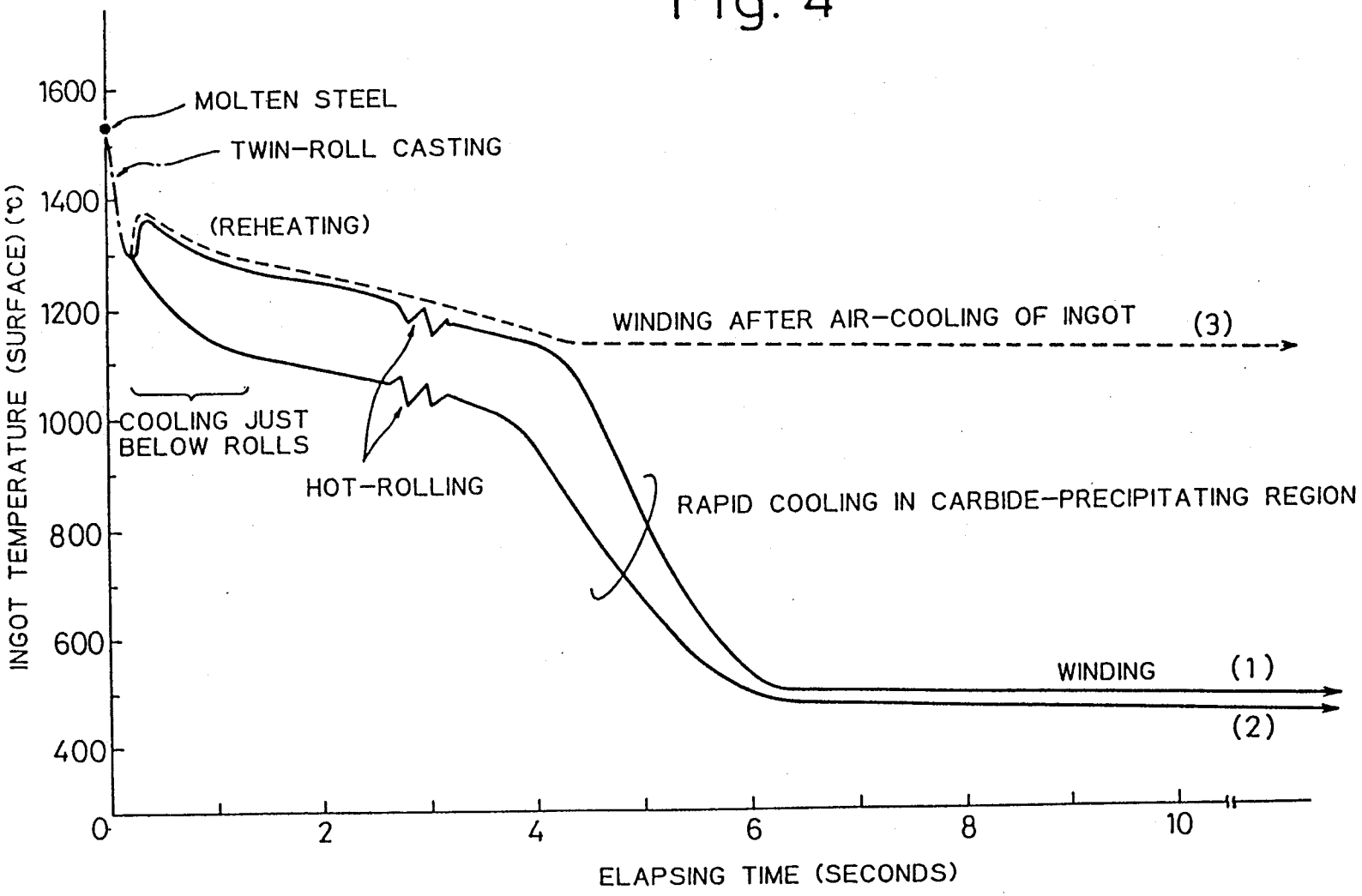
FIG. 4 is a diagram illustrating the relation between the temperature of the cast strip and the time, observed when a cast strip of Cr-Ni type stainless steel is formed steel by a twin-roll continuous casting machine (of the water-cooling type).

FIG. 4 shows the temperature history of the cast strip formed by continuously casting a molten steel by the twin-roll method and winding the cast strip.

In the case (3) shown in FIG. 4, the cast strip is cast and is then air-cooled. Although the cast strip is rapidly cooled by a casting drum in a casting machine, the cast strip is reheated after the outlet of the casing machine, and therefore, cooling is slower than in the case where cooling is started just below the drum and if the cast strip is directly wound, the grain growth of $\gamma$ is advanced during cooling after winding, with the result that problems concerning the surface properties, such as roping, sensitization by precipitation of Cr carbide, and uneven gloss arise.

In the case (1) shown in FIG. 4, hot-rolling is carried out after casting to cause recrystallization in the cast strip and make $\gamma$ grains finer, and after hot-rolling, sensitization by precipitation of Cr carbide is prevented by rapid cooling.

In the case (2) shown in FIG. 4, to reduce the grain size of the cast strip greater than in the case (1), rapid cooling is carried out after casting and hot-working is then carried out. If hot-rolling is added, the $\gamma$ grains become finer than in the case (1), and therefore, very fine $\gamma$ grains can be obtained. After the hot-rolling, rapid cooling is carried out for preventing sensitization by precipitation of Cr carbide.

Influences of the reduction at the hot-rolling in this method will now be described with reference to FIG. 5.

Figure 5:
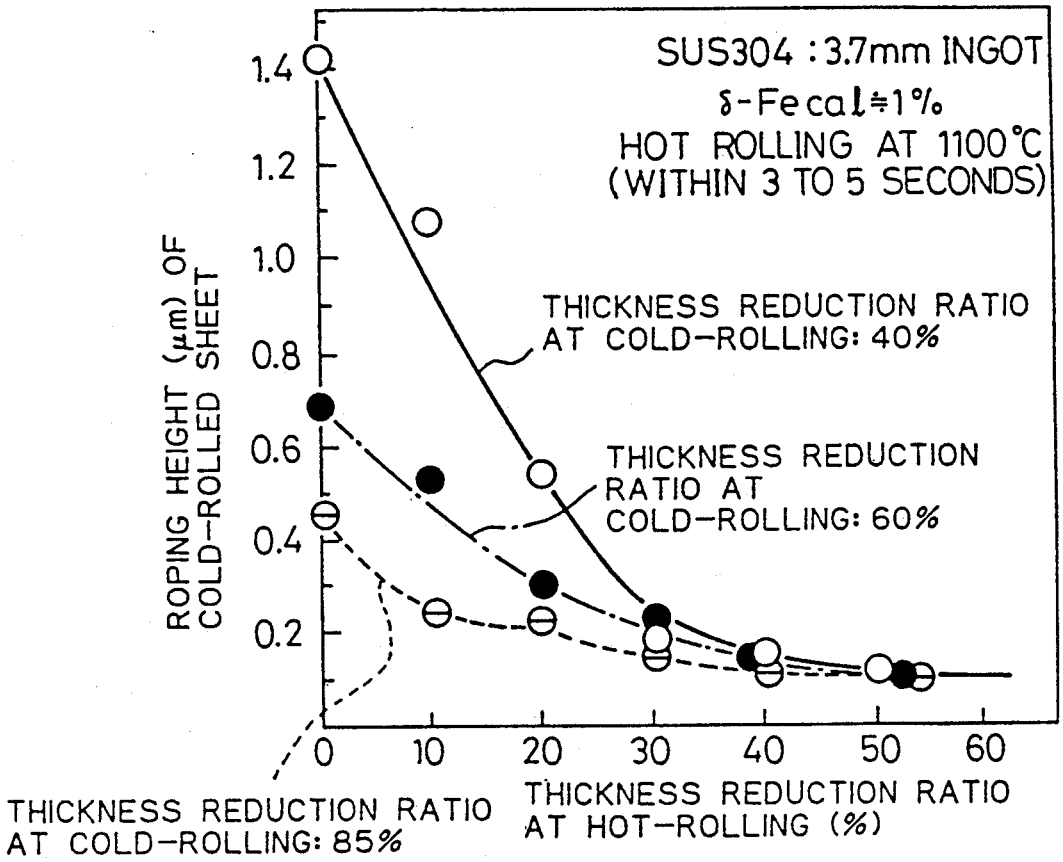
FIG. 5 is diagram illustrating influences of the thickness reduction ratio adopted when a cast strip obtained by carrying out casting at $\mu$-Fe.cal (%) of about 1% and then carrying out cooling is hot-rolled at 1100° C. and the reduction adopted at the subsequent descaling cold-rolling on the roping height on the surface of the final product.

FIG. 5 illustrates influences of the reduction on the roping height in the cold-rolled sheet, observed when a cooled cast strip having $\delta$-Fe.cal (%) adjusted to about 1% is hot-rolled at 1100° C.

From FIG. 5 it is seen that the effect by the hot-rolling is satisfactory if the reduction is high than 20%, and if the reduction is higher than 30%, the roping height of the product is reduced and no surface undulation is found.

If the reduction at the hot-rolling is higher than 20%, recrystallization is caused in the center of the cast strip and if the reduction is higher than 30%, the entire surface is substantially recrystallized. Thus, the average grain size of the $\gamma$ grains is reduced below 50 $\mu$m.

In the case where $\delta$-Fe.cal (%) is adjusted to about 3%, if the cast strip is cooled just below twin rolls (cooling drums) and hot-rolling is carried out with a temperature difference between the surface layer of the cast strip and the center of the cast strip, a good roping-preventing effect can be attained even if the reduction is about 10%. It is seen that the volume fraction of $\delta$-Fe. is larger and the effect of cooling the cast strip just below twin rolls (cooling drums) is high.

Hot-rolling is carried out in the region where the surface temperature of the cast strip is higher than 900° C., and recrystallization in the center of the cast strip is promoted by this hot-rolling. Especially, it is sufficient if the cast strip is subjected to hot-rolling at a reduction of up to 60% while the interior of the cast strip is still in the high-temperature region (within 10 seconds after the casting). If the reduction exceeds 60%, the effect is saturated. If hot-rolling is started after the elapse of more than 10 seconds from the point of termination of the casting, the temperature difference between the surface layer portion of the cast strip and the interior of the cast strip becomes small and the effect of making $\gamma$ grains finer is reduced.

If hot-working is carried out, it sometimes happens that recrystallization is not sufficiently caused but a worked microstructure is partially left. It was found that in this case, if the hot-rolled sheet is annealed to effect recrystallization, a product having excellent surface properties can be obtained.

Annealing of the hot-rolled sheet is carried out at a temperature higher than 950° C. to advance recrystallization. Especially, annealing is conducted while controlling the temperature and time so that the average grain size of $\gamma$ does not exceed 50 $\mu$m. During the annealing, the amount of $\delta-$Fe is reduced as compared with the amount of $\delta$-Fe at the stage of the cast strip, and precipitation of Cr carbide in the $\delta/\gamma$ interface is delayed and hence, it is permissible to adopt a lower cooling rate than the cooling rate adopted for cooling the cast strip or hot-rolled sheet. Accordingly, the cooling rate after annealing is adjusted to at least 10° C./sec in the Cr carbide-precipitating region.

(3) Method for cold-rolling and annealing the cast strip to effect recrystallization and reduce the grain size According to this method, cooling of the cast strip obtained by the above-mentioned continuous casting machine of the twin-roll type is started just below the casting machine at a temperature as high as possible, and cooling to 1100° C. is conducted at a cooling rate of at least 100° C./sec to inhibit the grain growth of $\gamma$. Then, cooling is conducted at a cooling rate of at least 50° C./sec in the temperature range of 900 to 550° C and the cast strip is wound in the region of temperature s lower than 650° C. The obtained cast strip is subjected to preliminary cold-working such as cold-rolling, and then subjected to high-temperature short-time annealing to effect recrystallization in the cast strip.

Figure 6:
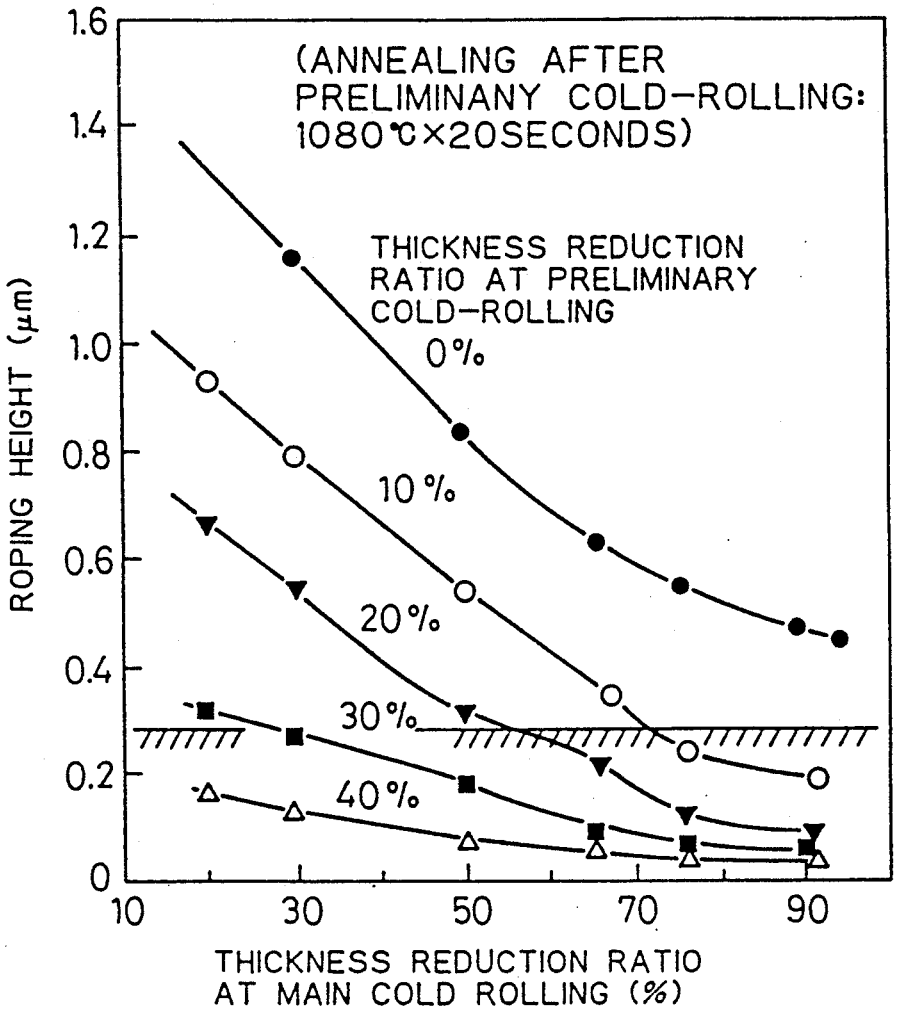
FIG. 6 is a diagram illustrating the relation between the reduction adopted when preliminary cold-rolling (cold-working) of a cast strip (thin band) under application of a variable thickness reduction ratio is carried out in the process of the present invention, annealing is carried out at 1080° C. for a short time to effect recrystallization, and cold-rolling (main cold-rolling) to the final product thickness is carried out, and the roping height on the surface of the final product.

Cast strips were subjected to preliminary cold rolling and then to short-time annealing at 1080° C., and cold-rolling (main cold-rolling) to the final sheet thickness was carried out. The relationship between the reduction and the roping height in the product is shown in FIG. 6, relative to the reduction at the preliminary cold-rolling.

Where $\gamma$ grains of the cast strip are fine, when a cast strip having a thickness of, for example, 2 mm is prepared by continuous casting and cooling of the cast strip just below the casting machine in the temperature region of 1300° to 1100° C. is carried out at such a high cooling rate as at least 100° C./sec, recrystallization is sufficiently advanced even if the reduction at the preliminary cold-rolling is at such a low level as at least 10%, and the average grain size of $\gamma$ can be reduced below 50 $\mu$m and the roping height in the product can be reduced.

As pointed out hereinbefore, if cooling of the cast strip just below the casting machine in the temperature region of 1300° to 1100° C. is carried out at a high cooling rate of at least 100° C./sec, recrystallization can be accomplished even when the reduction at the preliminary cold working (cold-rolling or the like) is low and the average grain size of $\gamma$ after the recrystallization can be reduced below 50 $\mu$m. Accordingly, occurrence of roping in the product can be reduced and a product having no uneven gloss and excellent surface properties can be obtained.

If $\delta-$Fe.cal (%) in the composition of the cast strip is adjusted from $-2$ to 10%, $\gamma$ grains can easily be made finer cojointly with cooling in the high-temperature region.

The effects of the present invention will now be described in detail with reference to the following examples.

EXAMPLES

EXAMPLE 1

Stainless steels composed mainly of the 18 Cr-8 Ni system, in which the amount of Ni was mainly changed, were melted and cast into ingot having a thickness of 1 to 7.5 mm by using a twin-roll casting machine of the internal water-cooling type. The compositions of the stainless steels were as shown in Table 1, and δ−Fe.cal (%) was changed in the range of from −3.6 to 7.8%.

On the outlet side of the casting machine, cooling methods for blowing high-pressure nitrogen gas was disposed, and cooling methods including a roll of the internal cooling type was subsequently arranged. By using these cooling methods, the cast strips were cooled while preventing reheating. In some runs, mist cooling methods was arranged after the roll-cooling methods. The average cooling rate to 1200° C. was adjusted to 400° to 220° C./sec according to the thickness of the cast strip, that is, the casting rate. Then, water cooling was carried out in the temperature region of 900° to 550° C. at a cooling rate of at least 50° C./sec, followed by winding.

From the results of the observation of textures of the obtained cast strips, as shown in Table 2, it was found that when δ−Fe.cal (%) was lower than about 1%, diameters of γ grains could be recognized and the average grain size of γ cast strips was about 30 to about 40 μm. However, in the ingots where δ−Fe.cal (%) was higher than 2%, the δ-Fe. phase was fine, the γ grain boundary could not be recognized, and γ grains locally observed were very fine and the grain size was smaller than 20 μm. When these cast strips were directly cold-rolled, occurrence of roping was not observed on the surface, and the surface properties were good. On the other hand, in comparative steels, δ−Fe.cal (%) was about −3% and the effect of δ solidification was not exerted, and moreover, the average cooling rate to 1200° C. was insufficient and the grain size of γ exceeded 80 μm. Therefore, the surface gloss and prevention of roping were not satisfactory.

TABLE 1

| | Run No. | Chemical Composition (% by weight) | | | | | | | | | | | | |
|---|---|---|---|---|---|---|---|---|---|---|---|---|---|---|
| | | C | Si | Mn | P | S | Cr | Ni | Mo | Cu | N | Al | O | Others |
| Method of present invention | 1 | 0.050 | 0.50 | 1.01 | 0.027 | 0.005 | 18.3 | 9.55 | 0.07 | 0.02 | 0.045 | 0.015 | 0.0065 | |
| | 2 | 0.051 | 0.50 | 1.01 | 0.027 | 0.005 | 18.3 | 8.95 | 0.07 | 0.02 | 0.045 | 0.015 | 0.0065 | |
| | 3 | 0.050 | 0.50 | 1.01 | 0.027 | 0.004 | 18.3 | 8.90 | 0.07 | 0.02 | 0.045 | 0.015 | 0.0065 | |
| | 4 | 0.052 | 0.50 | 1.00 | 0.027 | 0.004 | 18.4 | 7.60 | 0.07 | 1.8 | 0.045 | 0.020 | 0.0070 | |
| | 5 | 0.051 | 0.50 | 1.00 | 0.027 | 0.004 | 18.4 | 10.15 | 2.01 | 0.01 | 0.045 | 0.020 | 0.0070 | |
| | 6 | 0.050 | 0.50 | 1.00 | 0.027 | 0.005 | 18.4 | 7.20 | 0.04 | 0.01 | 0.045 | 0.020 | 0.0070 | |
| | 7 | 0.050 | 0.50 | 1.00 | 0.027 | 0.005 | 18.4 | 10.40 | 0.04 | 0.02 | 0.045 | 0.011 | 0.0070 | Nb 0.60 |
| | 8 | 0.051 | 0.50 | 1.02 | 0.027 | 0.003 | 25.2 | 9.73 | 0.04 | 0.02 | 0.303 | 0.011 | 0.0062 | |
| | 9 | 0.050 | 0.50 | 1.00 | 0.027 | 0.005 | 18.4 | 10.04 | 0.04 | 0.02 | 0.045 | 0.020 | 0.0070 | Ti 0.20 |
| Comparative method | 10 | 0.049 | 0.50 | 1.02 | 0.027 | 0.003 | 18.4 | 11.20 | 0.04 | 0.02 | 0.044 | 0.011 | 0.0062 | |
| | 11 | 0.052 | 0.50 | 1.02 | 0.027 | 0.003 | 18.5 | 11.27 | 0.04 | 0.02 | 0.044 | 0.011 | 0.0062 | |

TABLE 2

| | Run No. | δ-Fe.cal (%) | Cast strip Thickness (mm) | Cooling from Outlet of Casting Machine: high-pressure air cooling | roll cooling | mist cooling | Cooling rate (°C./sec) to 1200° C. | Average Grain Size (μm) of γ | Product Surface (roping and gloss) |
|---|---|---|---|---|---|---|---|---|---|
| method of present invention | 1 | 1.2 | 2.0 | o | | | 220 | 45 | good |
| | 2 | 2.9 | 2.5 | o | o | | 280 | 40 | " |
| | 3 | 3.1 | 3.3 | | o | | 220 | 40 | " |
| | 4 | 4.2 | 7.5 | o | o | o | 400 | 40 | " |
| | 5 | 5.5 | 4.5 | | o | o | 230 | 35 | " |
| | 6 | 7.8 | 2.5 | o | o | | 230 | 35 | " |
| | 7 | 0.7 | 1.6 | o | | | 250 | 45 | " |
| | 8 | −1.0 | 3.0 | o | | o | 250 | 30 | " |
| | 9 | −0.2 | 2.7 | o | o | o | 280 | <30 | " |
| comparative method | 10 | −3.3 | 3.3 | — | — | — | 80 | 80 | bad |
| | 11 | −3.6 | 3.0 | — | — | — | 80 | 90 | " |

EXAMPLE 2

Various stainless steels of the Cr-Ni system based on 18 Cr-8 Ni steel, which had compositions shown in Table 3, were melted. As shown in Table 4, in these molten steels, δ-Fe.cal (%) represented by the formula of δ−Fe.cal (%)=3(Cr+1.5 Si+Mo+Nb+Ti)−2.8-(Ni+½ Mn+½ Cu)−84(C+N)−19.8 (%) was changed in the range of from −3.55% to 7.81%. These molten steels were cast into strips having a thickness of 1.6 to 7.5 mm by a vertical twin-roll continuous casting machine of the internal water-cooling type. Cooling of the cast strips just below of the casting machine was effected by roll-cooling or spray-cooling, and the cooling rate was adjusted to 70° to 250° C./sec in the temperature region of 1400 to 1100° C.

Then, the cast strips were hot-rolled in the temperature region of 1100° to 950° C. within 8 seconds from the point of termination of casting. The reduction at this hot-rolling was in the range of from about 10% to about 60% (Table 4). Then, the cast strips were cooled at a cooling rate of at least 60° C./sec in the temperature region of 900° to 550° C. and the cast strips were wound at a temperature lower than 600° C.

In the comparative runs, hot-rolling was omitted or the cooling rate after annealing of the hot-rolled sheet was lower than 10° C./sec.

Then, the cast strips were subjected to pickling, descaling, cold-rolling, and ordinary annealing or bright annealing.

The surface properties of the obtained products were examined, and especially, the roping height and gloss on the surfaces of the products were checked. As shown in Table 4, in the products obtained in the present example, γ grains were made finer by the hot-rolling effect, and since subsequent cooling was sufficient, each product had excellent surface properties.

On the other hand, in the comparative runs, no effect was attained by hot-rolling and cooling of the cast strips was insufficient, and the winding temperature was high. Accordingly, roping on the product surface was conspicuous and the surface gloss was bad.

TABLE 3

| | Run No. | Chemical Composition (% by weight) C | Si | Mn | P | S | Cr | Ni | Mo | Cu | N | Al | O | Others |
|---|---|---|---|---|---|---|---|---|---|---|---|---|---|---|
| Method of present invention | 12 | 0.050 | 0.50 | 1.01 | 0.027 | 0.005 | 18.3 | 9.55 | 0.07 | 0.02 | 0.045 | 0.015 | 0.0065 | |
| | 13 | 0.051 | 0.54 | 1.08 | 0.031 | 0.003 | 18.4 | 8.95 | 0.01 | 0.14 | 0.039 | 0.010 | 0.0038 | |
| | 14 | 0.050 | 0.59 | 1.21 | 0.029 | 0.004 | 18.8 | 8.90 | 0.09 | 0.20 | 0.061 | 0.007 | 0.0041 | |
| | 15 | 0.052 | 0.74 | 1.00 | 0.027 | 0.002 | 18.4 | 7.60 | 0.14 | 1.8 | 0.057 | 0.020 | 0.0070 | |
| | 16 | 0.051 | 0.71 | 0.88 | 0.025 | 0.006 | 18.1 | 10.15 | 2.01 | 0.01 | 0.039 | 0.029 | 0.053 | |
| | 17 | 0.050 | 0.69 | 0.83 | 0.030 | 0.005 | 18.3 | 7.20 | 0.04 | 0.10 | 0.043 | 0.014 | 0.003 | |
| | 18 | 0.050 | 0.54 | 0.82 | 0.030 | 0.005 | 18.5 | 10.40 | 0.06 | 0.02 | 0.049 | 0.011 | 0.0052 | Nb 0.60 |
| | 19 | 0.051 | 0.51 | 1.02 | 0.024 | 0.003 | 25.2 | 9.73 | 0.09 | 0.10 | 0.303 | 0.010 | 0.0062 | |
| | 20 | 0.035 | 0.70 | 0.84 | 0.025 | 0.004 | 18.3 | 8.70 | 0.11 | 0.21 | 0.041 | 0.004 | 0.0047 | Ti 0.31 |
| | 21 | 0.071 | 1.20 | 0.86 | 0.035 | 0.002 | 18.7 | 8.32 | 0.09 | 0.08 | 0.051 | 0.017 | 0.002 | |
| | 22 | 0.029 | 0.75 | 1.84 | 0.031 | 0.006 | 18.7 | 9.10 | 0.10 | 0.04 | 0.039 | 0.034 | 0.0034 | |
| | 23 | 0.015 | 0.56 | 0.88 | 0.024 | 0.004 | 24.7 | 14.40 | 2.95 | 1.5 | 0.15 | 0.031 | 0.0026 | |
| Comparative method | 24 | 0.049 | 0.50 | 1.02 | 0.024 | 0.005 | 18.4 | 11.20 | 0.04 | 0.02 | 0.044 | 0.011 | 0.0036 | |
| | 25 | 0.052 | 0.50 | 1.21 | 0.034 | 0.003 | 18.5 | 11.27 | 0.10 | 0.10 | 0.049 | 0.040 | 0.0048 | |
| | 26 | 0.038 | 0.56 | 0.80 | 0.022 | 0.003 | 18.7 | 8.70 | 0.11 | 0.09 | 0.042 | 0.015 | 0.0033 | |
| | 27 | 0.054 | 0.47 | 0.83 | 0.031 | 0.003 | 18.3 | 8.50 | 0.10 | 0.12 | 0.043 | 0.021 | 0.0041 | |

TABLE 4

| | Run No. | δ-Fe.cal (%) of cast strip | Cast strip thickness (mm) | Cooling rate (°C./sec) to 1100° C. after casting | Reduction at hot-rolling (%) | Cooling rate (°C./sec) in carbide-precipitating region | Hot-rolled sheet annealing condition and cooling speed | Average grain size (μm) of γ before cold-rolling | Reduction (%) at cold-rolling | Surface properties of product roping | gloss |
|---|---|---|---|---|---|---|---|---|---|---|---|
| method of present invention | 12 | 1.22 | 2.0 | 150 | 15 | 70 | — | 20 | 1.7→0.4 (76%) | good | good |
| | 13 | 3.53 | 2.5 | 150 | 25 | 60 | 1050° C. × 20 s (25° C./s) | 25 | 1.8→0.6 (67%) | " | " |
| | 14 | 3.31 | 3.3 | 220 | 30 | 60 | — | 24 | 2.3→0.8 (65%) | " | " |
| | 15 | 4.79 | 7.5 | 180 | 44 | 80 | — | 44 | 4.2→1.0 (76%) | " | " |
| | 16 | 6.50 | 4.5 | 200 | 10 | 60 | — | 33 | 4.1→0.6 (85%) | " | " |
| | 17 | 9.05 | 2.5 | 200 | 15 | 65 | — | 27 | 2.1→0.6 (71%) | " | " |
| | 18 | −0.30 | 1.6 | 250 | 15 | 55 | — | 36 | 1.4→0.3 (79%) | " | " |
| | 19 | −2.3 | 3.0 | 80 | 55 | 70 | — | 41 | 1.4→0.5 (63%) | " | " |
| | 20 | 6.37 | 2.8 | 130 | 57 | 65 | 1080° C. × 15 s (35° C./s) | 46 | 2.3→0.6 (74%) | " | " |
| | 21 | 7.11 | 3.7 | 110 | 33 | 80 | — | 32 | 2.5→0.8 (68%) | " | " |
| | 22 | 6.15 | 2.5 | 130 | 22 | 80 | — | 31 | 2.0→0.8 (60%) | " | " |
| | 23 | 8.16 | 4.2 | 150 | 25 | 60 | — | 24 | 3.2→0.9 (71%) | " | " |
| comparative method | 24 | −3.33 | 2.3 | 80 | — | 40 | — | 300 | 2.3→1.0 (57%) | bad | bad |
| | 25 | −3.62 | 2.6 | 80 | — | 40 | — | 340 | 2.6→0.8 (69%) | " | " |
| | 26 | 6.82 | 2.8 | 150 | — | 0.8 | — | 120 | 3.8→1.2 (68%) | good | " |
| | 27 | 4.24 | 2.8 | 70 | 15 | 55 | 1150° C. × 3 min (5° C./s) | 82 | 2.4→1.0 (58%) | bad | " |

EXAMPLE 3

Stainless steels of the Cr-Ni system represented by 18 Cr-8 Ni, which were melted according to customary procedures, were cast in strips having a thickness of 3 mm or 4.5 mm by using a twin drum machine of the internal water-cooling type. The compositions of the steels were as shown in Table 5. Air cooling and spray cooling were carried out just below the outlet of the twin-drum casting machine. Cooling to 1100° C. was conducted at an average cooling rate of at least 100° C./sec, and water cooling was conducted in the temperature region of 900° to 550° C. at an average cooling rate of at least 70° C./sec. Winding was then carried out at temperatures of 650° to 600° C.

The cast strips were descaled by mechanical descaling and pickling and were preliminarily rolled by cold-rolling. Both the cast strips having a thickness of 3 mm and the cast strips having a thickness of 4.5 mm were preliminarily cold-rolled at a reduction of 10 to 40%, annealed for less than 20 seconds at a temperature higher than 1000° C., and rapidly cooled. Thus, the cast strips were recrystallized and the grain size of γ was controlled below 50 μm.

Then, the cast strips were subjected to the main drawing at a reduction of 30, 50, 80, or 95% or a reduction higher than 95%, and final annealing was carried out according to customary procedures to obtain 2B and BA products. As shown in Table 6, these products were excellent in surface properties and mechanical properties.

In the comparative runs shown in Table 7, molten steels having the same compositions as described above were cast according to the twin-drum method, and cooling to 1100° C. was carried out at a cooling rate lower than 100° C./sec and cooling to 550° C. was carried out at a cooling rate of 70° C./sec. The cast strips were wound at a temperature of 650° to 600° C., descaled, and cold-rolled to obtain products. If the reduction at the cold-rolling was increased, the surface properties were improved, but fine roping was left on the surface and the effect of preventing roping was insufficient.

TABLE 5

| Run No. | Chemical composition (% by weight) C | Si | Mn | P | S | Cr | Ni | N | Al | O | Mo | Ingot thickness (mm) |
|---|---|---|---|---|---|---|---|---|---|---|---|---|
| 28 | 0.050 | 0.60 | 0.90 | 0.026 | 0.004 | 18.6 | 8.6 | 0.044 | 0.03 | 0.0066 | — | 3.0 |
| 29 | 0.045 | 0.55 | 1.30 | 0.025 | 0.003 | 18.4 | 9.5 | 0.036 | 0.02 | 0.0055 | — | 4.5 |
| 30 | 0.066 | 0.62 | 1.06 | 0.030 | 0.004 | 16.6 | 11.9 | 0.045 | 0.03 | 0.0045 | 2.20 | 3.0 |

TABLE 6

| | Run No. | Reduction (%) at preliminary rolling | Intermediate annealing | Grain size (μm) of γ | Reduction (%) at main rolling | Surface properties, especially prevention of roping |
|---|---|---|---|---|---|---|
| method of present invention | 28 | 10 | 1080° C. × 5 seconds | 30 | 40 | good |
| | | 20 | 1080° C. × 5 seconds | 19 | 70 | good |
| | | 40 | 1080° C. × 5 seconds | 16 | 90 | good |
| | 29 | 10 | 1080° C. × 5 seconds | 45 | 70 | good |
| | | 30 | 1080° C. × 5 seconds | 26 | 95.5 | good |
| | 30 | 10 | 1100° C. × 15 seconds | 32 | 80 | good |
| | | 20 | 1100° C. × 15 seconds | 22 | 95 | good |
| | | 30 | 1100° C. × 15 seconds | 19 | 98 | good |

TABLE 7

| | Run No. | Cooling rate (°C./sec) to 1100° C. | Grain size (μm) of γ in cast strip | Reduction (%) at final cold-rolling | Surface properties, especially prevention of roping |
|---|---|---|---|---|---|
| Comparative method | 28 | 80 | 70 | 70 | bad |
| | | | | 90 | bad |
| | 29 | 70 | 95 | 66 | bad |
| | | | | 88 | bad |
| | 30 | 90 | 65 | 50 | bad |
| | | | | 65 | bad |
| | | | | 88 | bad |

INDUSTRIAL APPLICABILITY

Since the present invention has the above-mentioned structure and exerts the above-mentioned function, a simple process in which a thin band having a thickness close to the product thickness can be directly obtained by continuous casting can be provided, and a Cr-Ni type stainless steel sheet having excellent surface property and material quality can be obtained.

We claim:

1. A process for the production of a Cr-Ni type stainless steel sheet having excellent surface feature and material quality, which comprises continuously casting a Cr-Ni type stainless steel represented by 18% Cr-8% Ni steel into a strip having a thickness smaller than 10 mm at a cooling rate of at least 100° C./sec at the solidification by using a continuous casting machine in which the wall surface of a casting mold moves synchronously with the cast strip consisting of, δ-Fe.cal (%) defined by the formula of δ-Fe.cal (%)=3(Cr+3/2 Si+Mo+Nb+Ti)−2.8 (Ni +½ Mn+½ Cu)−84(C+N)−19.8 (%) being controlled from −2 to 10% to form a primary crystal of the δ phase at the solidification, lower the temperature of initiation of crystallization or precipitation of γ grains and depress the growth of γ grains during and after the solidification, initiating cooling of the obtained cast strip at a temperature as high as possible, cooling the cast strip to 1100° C. at a cooling rate of at least 100° C./sec while preventing reheating of the cast strip to make the γ grains finer, and forming the cast strip into a cold-rolled sheet according to customary procedures.

2. A process according to claim 1, wherein the obtained cast strip is cooled to 1200° C. at a cooling rate of at least 200° C./sec to make the γ grains finer so that the average grain size is smaller than 50 μm.

3. A process according to claim 1 or 2, wherein cooling to 1200° C. at a cooling rate of at least 200° C./sec is effected by at least one pair of rolls of the internal cooling type so that the reduction in the cast strip is lower than 5%.

4. A process according to claim 1, 2, or 3, wherein cooling of the cast strip after the solidification is effected by using a gas and/or a liquid.

5. A process for the production of a Cr-Ni type stainless steel sheet having excellent surface feature and material quality, which comprises continuously casting a Cr-Ni type stainless steel represented by 18% Cr−8% Ni steel into a strip having a thickness smaller than 10 mm at a cooling rate of at least 100° C./sec at the solidification by using a continuous casting machine in which the wall surface of a casting mold moves synchronously with the cast strip, hot-working the cast strip in the region of temperatures higher than 900° C. at a reduction lower than 60% after the solidification to advance recrystallization in the interior of the cast strip and make γ grains finer so that the average grain size of γ is smaller than 50 μm, and forming the cast strip into a cold-rolled sheet according to customary procedures.

6. A process according to claim 5, wherein at the casting, $\delta-$Fe.cal (%) of the cast strip defined by the formula of $\delta-$Fe.cal (%)$=3(Cr+3/2Si+Mo+Nb+Ti)-2.8\ (Ni+\frac{1}{2}\ Mn+\frac{1}{2}\ Cu)-84(C+N)-19.8$ (%) is controlled from $-2$ to 10% to form a primary crystal of the $\delta$ phase at the solidification, lower the temperature of initiation of crystallization or transformation of $\gamma$ grains and depress the growth of $\gamma$ grains during and after the solidification.

7. A process for the production of a Cr-Ni type stainless steel sheet having an excellent surface feature and material quality, which comprises continuously casting a Cr-Ni type stainless steel represented by 18% Cr−8% Ni steel into a strip having a thickness smaller than 10 mm at a cooling rate of at least 100° C./sec at the solidification by using a continuous casting machine in which the wall surface of a casting mold moves synchronously with the cast strip consisting of $\delta$-Fe.cal (%) defined by the formula of $\delta-$Fe.cal (%)$=3(Cr+3/2Si+Mo+Nb+Ti)-2.8(Ni+\frac{1}{2}\ Mn+\frac{1}{2}\ Cu)-84(C+N)-19.8$ (%) being controlled from $-2$ to 10% to form a primary crystal of the $\delta$ phase at the solidification, lower the temperature of initiation of crystallization or transformation of $\gamma$ grains and depress the growth of $\gamma$ grains from the intermediate point of the solidification, initiating cooling of the obtained cast strip at a temperature as high as possible while preventing reheating of the cast strip after the solidification, adjusting the average cooling rate at least 100° C./sec as measured with respect to the surface temperature of the cast strip to depress the growth of the $\gamma$ grains, hot-working the cast strip in the region of temperatures higher than 900° C. at a reduction lower than 60% within 10 seconds from the point of termination of the casting where there is present a temperature difference between the surface portion of the cast strip and the center of the cast strip, to advance recrystallization in the center of the cast strip and make the $\gamma$ grains in the cast strip finer so that the average grain size the of $\gamma$ is smaller than 50 $\mu$m, and forming the cast strip into a cold-rolled sheet according to customary procedures.

8. A process according to claim 5, 6, or 7, to winding in the region of temperatures rolling said sheet followed by annealing at a temperatures lower than 650° C. after hot rolling said sheet followed by annealing at a temperature higher than 950° C. for a controlled time and is then subjected to cooling at a cooling rate of at least 10° C./sec.

9. A process for the production of a Cr-Ni type stainless steel sheet having excellent surface feature and material quality, which comprises continuously casting a Cr-Ni type stainless steel represented by 18% Cr−8% Ni steel into a strip having a thickness smaller than 10 mm at a cooling rate of at least 100° C./sec at the solidification by using a continuous casting machine in which the wall surface of a casting mold moves synchronously with the cast strip, initiating cooling of the obtained cast strip at a temperature as high as possible, cooling the cast strip to 1100° C. at a cooling rate of at least 100° C./sec while preventing reheating of the cast strip, to depress the grain growth of $\gamma$, then cooling the cast strip in the temperature region of 900° to 550° C. at a cooling rate of at least 50° C./sec, winding the cast strip in the region of temperature lower than 650° C., pickling the cast strip without annealing, subjecting the cast strip to preliminary cold-rolling at a reduction lower than 60%, then annealing the cast strip at a temperature higher than 850° C. to advance recrystallization and adjust the average grain size of $\gamma$ below 50 $\mu$m, pickling the cast strip, cold-rolling the cast strip to a final product sheet thickness, subjecting the obtained cold-rolled sheet to final annealing, and pickling or bright annealing.

10. A process according to claim 9, wherein at the casting $\delta-$Fe.cal (%) of the cast strip defined by the formula of $\delta$-Fe.cal (%)$=3(Cr+3/2Si+Mo+Nb+Ti)-2.8(Ni+\frac{1}{2}\ Mn+\frac{1}{2}\ Cu)-84(C+N)-19.8$ (%) is controlled from $-2$ to 10% to form a primary crystal of the $\delta$ phase at the solidification, lower the temperature of initiation of crystallization or transformation of $\gamma$ grains and depress the growth of $\gamma$ grains during and after the solidification.

* * * * *

UNITED STATES PATENT AND TRADEMARK OFFICE

CERTIFICATE OF CORRECTION

PATENT NO. : 5,030,296

DATED : July 9, 1991

INVENTOR(S) : M. UEDA et al.

It is certified that error appears in the above-identified patent and that said Letters Patent is hereby corrected as shown below:

Col. 16, lines 1-8, delete claim 8, and

Insert new claim 8 as follows:

-- 8. A process according to claim 5, 6, or 7 wherein the cast strip is subjected to winding in the region of temperatures lower than 650°C after hot rolling said sheet followed by annealing at a temperature higher than 950°C for a controlled time and then subjected to cooling at a cooling rate of at least 10°C/sec. --

Signed and Sealed this

Thirteenth Day of July, 1993

*Attest:*

Michael K. Kirk

MICHAEL K. KIRK

*Attesting Officer*

*Acting Commissioner of Patents and Trademarks*